US008585310B2

(12) United States Patent
Mindler

(10) Patent No.: US 8,585,310 B2
(45) Date of Patent: Nov. 19, 2013

(54) BINDER CLIP

(75) Inventor: Robert Fredric Mindler, Churchville, NY (US)

(73) Assignee: Kodak Alaris Inc., Rochester, NY (US)

( * ) Notice: Subject to any disclaimer, the term of this patent is extended or adjusted under 35 U.S.C. 154(b) by 286 days.

(21) Appl. No.: 13/076,596

(22) Filed: Mar. 31, 2011

(65) Prior Publication Data

US 2012/0248753 A1 Oct. 4, 2012

(51) Int. Cl.

| | |
|---|---|
| ***B42F 3/02*** | (2006.01) |
| ***B42F 13/02*** | (2006.01) |
| ***B42F 3/00*** | (2006.01) |
| ***B42F 13/12*** | (2006.01) |
| ***B42F 13/36*** | (2006.01) |
| ***B42F 1/00*** | (2006.01) |
| ***A44B 1/04*** | (2006.01) |
| ***A44B 11/25*** | (2006.01) |
| ***A44B 17/00*** | (2006.01) |

(52) U.S. Cl.

USPC ..... 402/21; 402/61; 402/64; 24/67.3; 24/67.9

(58) Field of Classification Search

USPC ..... 402/19–23, 61, 64–66, 71; 281/43, 281/45–47; 24/67 R–67 P

See application file for complete search history.

(56) References Cited

U.S. PATENT DOCUMENTS

| | | | | |
|---|---|---|---|---|
| 402,024 | A * | 4/1889 | Lomas | 281/47 |
| 434,160 | A * | 8/1890 | Rubel | 24/67.5 |
| 636,166 | A * | 10/1899 | Newbaker | 24/67.5 |
| 1,412,078 | A * | 4/1922 | Grimes | 24/67.5 |
| 1,580,459 | A * | 4/1926 | Westland | 24/67.11 |
| 1,633,070 | A * | 6/1927 | Crump | 281/48 |
| 1,655,017 | A * | 1/1928 | Leahy | 281/47 |
| 3,298,374 | A * | 1/1967 | Grundell | 281/45 |
| 5,550,572 | A | 8/1996 | Chang et al. | |
| 5,553,891 | A * | 9/1996 | Ong | 281/43 |
| 5,677,722 | A | 10/1997 | Park | |
| 5,791,692 | A | 8/1998 | Manico | |
| 5,957,502 | A | 9/1999 | Manico et al. | |
| 6,004,061 | A | 12/1999 | Manico | |
| 6,742,809 | B2 | 6/2004 | Frosig et al. | |
| 7,047,683 | B2 | 5/2006 | Austin | |
| 7,486,421 | B2 | 2/2009 | Yang | |
| 2008/0213032 | A1 * | 9/2008 | Hoarau et al. | 402/20 |

FOREIGN PATENT DOCUMENTS

| | | |
|---|---|---|
| JP | 2002326483 | * 11/2002 |
| JP | 2003251977 | * 9/2003 |

* cited by examiner

*Primary Examiner* — Kyle Grabowski

(57) ABSTRACT

A binder clip having flexible sidewalls biased to close around a rigid retainer for securing pages wrapped around the retainer or pinched by the binder clip and retainer for manually forming a book.

4 Claims, 10 Drawing Sheets

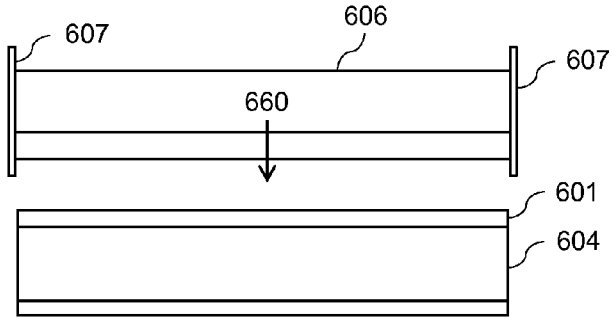
FIG 6B
FIG 6A
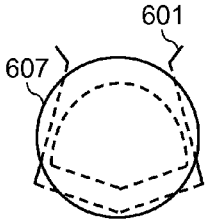
FIG 6D
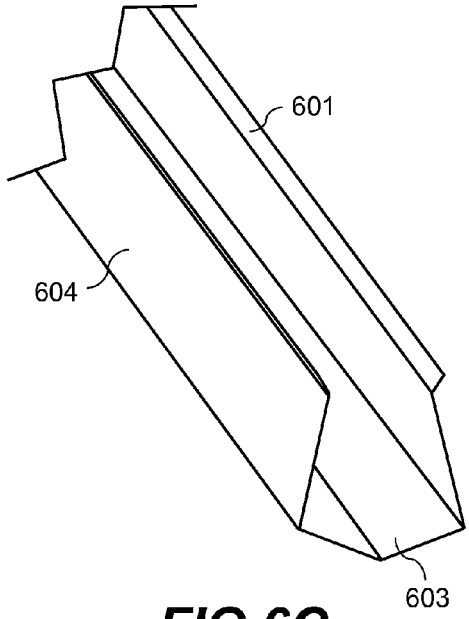
FIG 6C
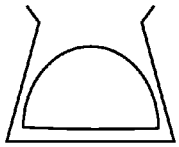
FIG 6E
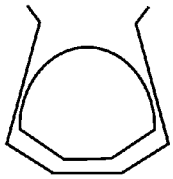
FIG 6F
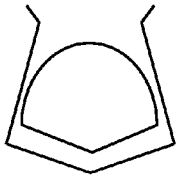
FIG 6G
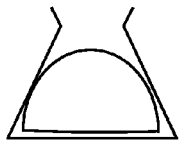
FIG 6H
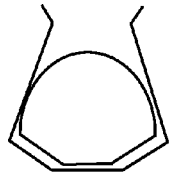
FIG 6I

BINDER CLIP

CROSS REFERENCE TO RELATED APPLICATIONS

Reference is made to commonly assigned, co-pending U.S. patent application Ser. No. 13/076,609 by Robert F. Mindler entitled "Binder Clip", filed concurrently herewith is assigned to the same assignee hereof, Eastman Kodak Company of Rochester, N.Y., and contains subject matter related, in certain respect, to the subject matter of the present application. The above-identified patent application is incorporated herein by reference in its entirety.

FIELD OF THE INVENTION

The present invention relates to a binder clip assembly which can be used for binding media sheets, methods for using the same, and methods of making the same.

BACKGROUND OF THE INVENTION

In recent years, the proliferation of digital photography has provided consumers with a variety of options to store captured images. These options include various "soft copy" methods involving memory cards, memory sticks, CD's, DVD's, hard drives, on-line storage etc. These "soft-copy" options, while providing the environmental benefit of eliminating the paper, ink or dye, and other chemicals required for "hard-copy" output, are potentially less secure for long term storage due to media format obsolescence, storage media physical or chemical breakdown, and on-line storage companies disappearing. A variety of options exist for customers to print digital images, including conventional silver halide processing, ink-jet, thermal dye transfer, and electrophotographic methods. These "hard-copy" methods are capable of providing printed output which can last for many decades. Although customers can make such "hard-copy" prints at home, modern retail outlets provide kiosks and order-terminals where both prints and additional services can be requested and provided. Similar services are also available from on-line companies such as Kodak Gallery. An increasingly popular service provides photo-albums or photo-books with collections of images associated with a specific event, such as a vacation, family gathering, school function etc. The photo-books are composed of printed images produced by any one of the printing methodologies described above.

Photo-books can be constructed in various formats. For example, single sheets of printed material bearing an image on one side of the material can be bound together using any one or a combination of binder clips, staples, adhesive, stitching, ring binders etc. Such photo-books are generally less preferred as each printed page of the book will face a blank page, i.e. the non-printed backside of a printed image. This disadvantage can be eliminated by adhering together sheets of single-side printed media to produce a double-sided album page as disclosed in U.S. Pat. Nos. 5,791,692, 5,957,502, 6,004,061 and 7,047,683. U.S. Pat. No. 6,742,809 describes a strip of images folded in accordion manner such that each pair of adjacent images forms two sides of a page, the accordion folds being adhered together on the inside. Photo-books produced by adhering two imaged prints together are typically thicker than single-sided sheet products, and this can result in a heavy and bulky product when the photo-book contains a large number of pages.

Duplex printers, which print on both sides of an imaging material, are known in the art. Typically these printers are of the electrophotographic type. Using these printers, photo-books can be constructed from the duplex sheets using any of the methods described above. Thermal transfer printing is known to produce higher quality images than conventional electrophotographic imaging, and would be the preferred printing method for high-quality photobooks. Duplex thermal transfer printers are disclosed in U.S. Pat. Nos. 5,550,572, 5,677,722 and 7,486,421. These patents do not disclose any method for using the duplex output from these printers to produce photo-books.

There is need to produce high quality photo-books from duplex printed sheets. There is also a need to manufacture a binding clip for such photo-books that holds the printed sheets securely in a cost-effective manner.

SUMMARY OF THE INVENTION

The binding clip disclosed herein can be used generally to bind media sheets of various types. Although the present invention relates to flexible binder clip arrangements for binding printed media sheets into a photo-book, and methods for making and using the same, the binder clip assembly can be used to bind any other kind of sheet that will fit into the binder clip assembly such as fabric swaths or swatches, and printed or handwritten pages.

A preferred embodiment of the present invention includes an elongated binding clip with multiple bottom and side surfaces. The sidewalls converge toward each other at a top opening of the clip, wherein two edges of the sidewalls are flexibly biased toward each other. A retainer substantially similar in length as the clip is disposed between the sidewalls and includes a substantially flat surface that substantially faces the multiple bottom surfaces.

Another preferred embodiment of the present invention includes a booklet comprising a plurality pages wrapped around the retainer and a clamp for compressively securing the pages around the retainer. The retainer optionally includes a flange on each end of the retainer and one or more substantially planar surfaces along the lengthwise dimension of the retainer. The assembly can be constructed manually and can be reused.

Another preferred embodiment of the present invention includes an assembly comprising a flexible binder clip enclosing a rod, wherein the binder clip is flexibly biased to enclose the rod. The rod is separable from the binder clip if the binder clip is flexed open for manually forming a book by placing pages between the rod and binder clip. The pages comprising a plurality of media sheets pinched between the rod and the binder clip whereby the sheets are held in place.

In answer to the needs identified above, there is provided in accordance with a preferred embodiment of the present invention a flexible elongated binder clip comprising a plurality of bottom surfaces formed at an angle with each other; a pair of sidewalls coextensive with the bottom surfaces and each integrally formed with one of the plurality of bottom surfaces; the pair of sidewalls converging toward each other at a top of the binder clip and including two elongated top edges coextensive with each other, with the sidewalls, and with the bottom surfaces, the two elongated edges flexibly biased toward each other; and an elongated retainer substantially similar in length as the sidewalls and the bottom surfaces disposed between the sidewalls and proximate to the bottom surfaces, the elongated retainer including at least one substantially flat surface that substantially faces one of the bottom surfaces, wherein the binder clip secures together in a booklet form a plurality of media sheets via a compressive biasing force of the sidewalls and elongated edges toward the retainer when the sheets are placed between the retainer and the sidewalls.

In another preferred embodiment of the invention, the binder clip is used to bind a plurality of sheets positioned centrally beneath the elongated retainer. In a third preferred embodiment of the invention, a plurality of sheets comprise photographic images positioned on both sides of the central divide. In a fourth preferred embodiment of the invention, a plurality of sheets comprise photographic images on both top and bottom sides of the sheet. In a fifth preferred embodiment of the invention, the binder clip is bonded to a stiffening sheet that is bonded to the external photo-book cover.

Another preferred embodiment of the present invention includes a booklet for securing pages of images formed into a booklet having a binding clip, bi-fold leaves (pages) and a bi-fold leaf retainer. Such a booklet includes a plurality pages with a centerline substantially bisecting each page wherein the retainer can secure the pages within a binding clip. The retainer is an elongated optionally substantially rigid rod, bar, or dowel, around which a plurality of pages are wrapped such that the centerline of each page is proximate a lengthwise dimension of the retainer. The binding clip clamps around the pages and the retainer when the pages and the retainer are disposed within the clamp for compressively securing the pages around the elongated retainer. The retainer is optionally made with a flange on each end for preventing it from sliding away from the assembly. The retainer can also be made with at least one substantially elongated planar surface along the lengthwise dimension of the retainer. This external surface(s) of the retainer faces a substantially parallel internal surface or surfaces of the binding clip when disposed in the binding clip.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

BRIEF DESCRIPTION OF THE DRAWINGS

FIGS. 6A-I illustrate a preferred embodiment of the present invention including views of the binding clip and retainer.

DETAILED DESCRIPTION OF THE INVENTION

Figure 1A:
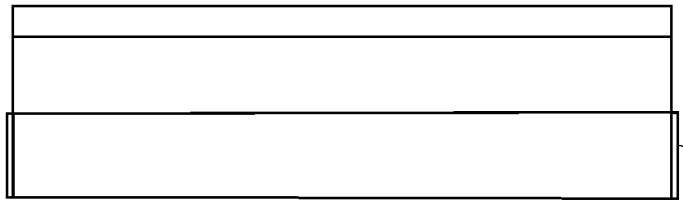
FIGS. 1A-C illustrate a preferred embodiment of the clamp portion of the present invention without retainer.
Figure 1B:
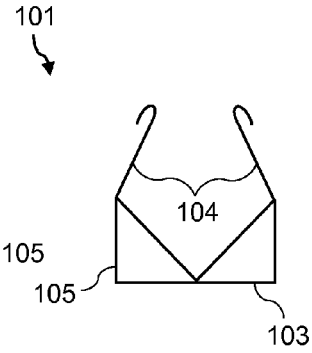
Figure 1C:
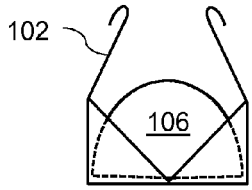

With reference to FIGS. 1A-C, there is illustrated a front and two side views, respectively, of the clamp, or binding clip, portion of a preferred embodiment of the present invention. Flexible clamping portions 104, each including an upper lip 101, are flexibly biased toward each other for securely holding a retainer 106 (shown in FIG. 1C) and sheets positioned therein, as described below. The upper lip can be rounded with a larger radius of curvature 102 to protect against wear of the sheets that are secured therein, as described below. In this embodiment, the base of the clip 103 is flat so that the clip can be placed on a flat surface without rolling. End portions 105 prevent a retainer enclosed within the clamp from sliding out therethrough. This advantage is illustrated in FIG. 1C showing retainer 106. As mentioned above, the illustration of FIG. 1C is not intended to limit the shape of the clamp or retainer in any way. It demonstrates that the retainer may be more securely held within the clamp portion by avoiding unintended release of the retainer by means of clamp end portions 105 formed thereon. To be fully utilized, the retainer and clamp should be easily manually separable and combinable in any event, with or without sheets, as will be described in greater detail below.

Figure 2A:
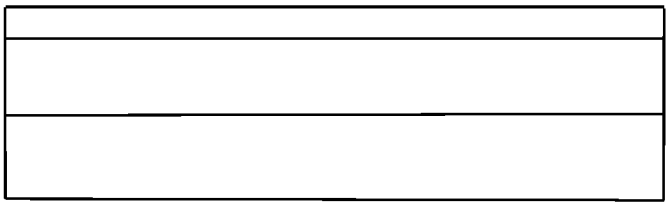
FIGS. 2A-B illustrate another preferred embodiment of the clamp portion of the present invention without retainer.
Figure 2B:
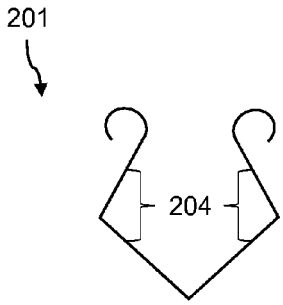

With reference to FIGS. 2A-B, there is illustrated a front and a side view, respectively, of the clamp, or binding clip, portion of a preferred embodiment of the present invention. Flexible clamping portions 204, terminating in upper lips 201, are flexibly biased toward each other for securely holding a retainer (not shown) and sheets positioned therein, similar to the operation of the embodiment shown in FIGS. 1A-C, as described below. The upper lip 201 is rounded to protect against wear of the sheets that are secured therein, as described below. This embodiment does not have a flat bottom surface, as in 103 of FIG. 1B.

Figure 3A:
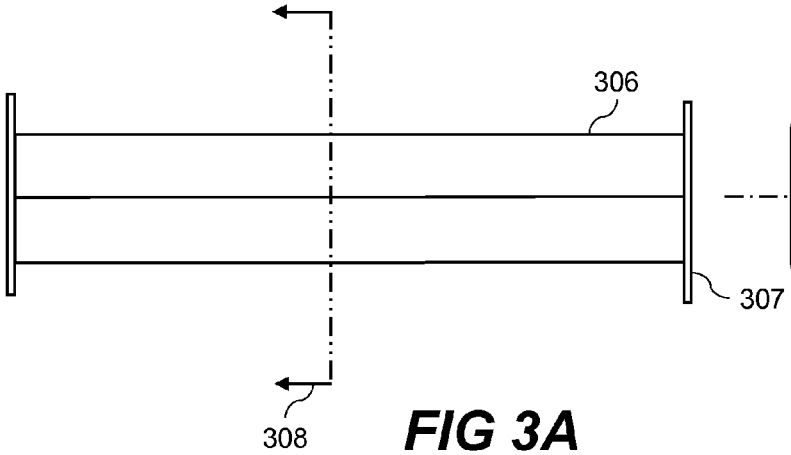
FIGS. 3A-C illustrate a preferred embodiment of the retainer of the present invention.
Figure 3B:
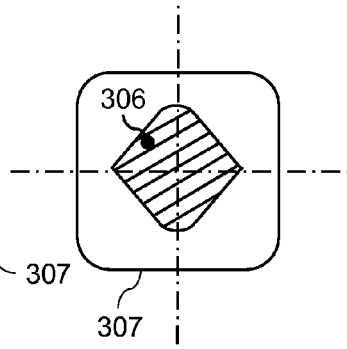
Figure 3C:
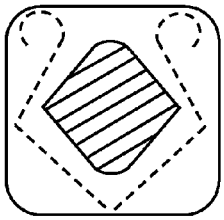

With reference to FIGS. 3A-B, there is illustrated a front and side view, respectively, of the retainer portion of a preferred embodiment of the present invention. Substantially rigid portion 306 can be fabricated as a rod, bar, dowel, tube, pipe, shaft, cylinder, of any suitable material, such as wood, metal, plastic, rubber, or any combination of these or other suitable materials, securely or removably attached to flange portion 307. The terms used herein, such as "dowel" are not intended to limit the cross-sectional shape of the retainer, for example, as a circular cross-section. The shape of the retainer includes various cross-sectional shapes as illustrated herein and the terms used apply to all these variations. The flange portion is shown here as a rectangle with rounded corners, however, as explained above, this illustration is not intended to be limiting. The flange portion can be of any shape. The retainer may be removed from the binding clip by moving it out from between the flexible portions 104 or 204 in the embodiments of FIGS. 1A-D or FIGS. 2A-C, wherein the force of pulling the retainer flexes apart the sidewalls 104 or 204 to make way for the retainer to be removed. Alternatively, the flange portion of the retainer may be removable from one end of the rod portion 306 of the retainer and the other end of the rod portion pulled by its flange portion from an end of the binding clip between the portions 104 or 204. The flange shape illustrated in FIGS. 3A-B assists in preventing rolling of the binder clip and flange assembly when the assembly is placed on a flat surface, such as shown in FIG. 3C which illustrates the retainer of FIG. 3B inserted in the binder clip of FIG. 2B. In this preferred embodiment illustrated in FIG. 3C, the cross sectional area of the flange is substantially the same size, or slightly larger, than the cross sectional area of the binder clip. This assembly as well as other assemblies of a binder clip and retainer illustrated and described herein are intended to be easily manually assembled and disassembled, interchangeable, and reused.

Figure 4A:
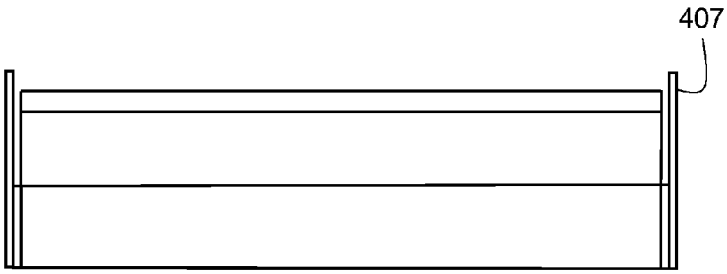
FIGS. 4A-B illustrate a preferred embodiment of the present invention including views of the binding clip (clamp), bi-fold leaf and bi-fold leaf retainer.
Figure 4B:
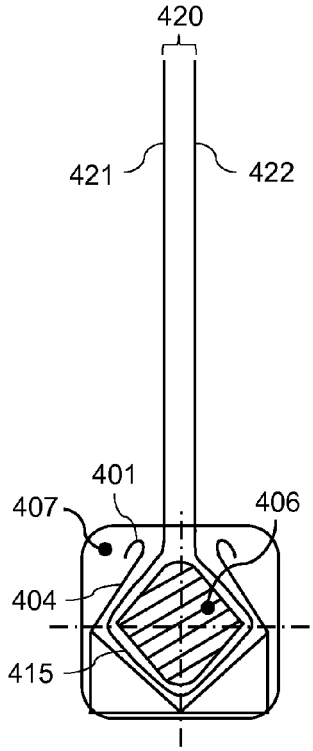

With reference to FIGS. 4A-B, there is illustrated a front and a side view, respectively, of the clamp, or binding clip, portion of a preferred embodiment of the present invention together with retainer contained therein, and sheets secured by the assembly as illustrated in FIG. 4B. In this example, the binder clip resembles the preferred embodiment illustrated in FIG. 1B and the retainer resembles the preferred embodiment illustrated in FIG. 3B. Flexible clamping portions 404, terminating in upper lips 401, are flexibly biased toward each other for securely holding a retainer 406 and media sheets 420 positioned therein, as described below. The sheets are seen as multiple pages with front page 421 whose opposite side is an interior page and back page 422 whose opposite side is also an interior page. FIG. 4B illustrates that sheets 420 are actually a continuous sheet that wraps around retainer 406 internal to the clamp portion 404. The portion 415 of sheets 420 in the interior of the clamp 404 can be made of a different material than the portion of the sheets external to the clamp or can be a continuous sheet of the same material. As mentioned above, the illustration of FIG. 4B is not intended to limit the shape of the sheet, clamp, or retainer in any way. The sheet can be composed of, for example, a flexible material portion that wraps around the retainer while the external surfaces outside the clamp that are exposed to view may be a different material, such as material suited for printing images thereon. This external portion can be a section of the sheet that is stiffer than the interior portion that wraps around the retainer, and it may or may not include stiffeners for reducing the flexibility of the exposed portions of the sheets. The sheets may be transparent plastic with a single or more pocket inserts for holding prints. The pocket inserts would be formed in the external portion of the sheets. The upper lip 401 of the clamp is rounded to protect against wear of the sheets that are secured therein as they are flexed open for viewing, as described below. This illustrated preferred embodiment utilizes the retainer design as illustrated in FIGS. 3A-B and can be used with the binding clip illustrated in FIG. 1C (shown in FIG. 4B) or in FIG. 2B, or any other form of binding clip shown herein or other forms not shown herein.

Figure 5A:
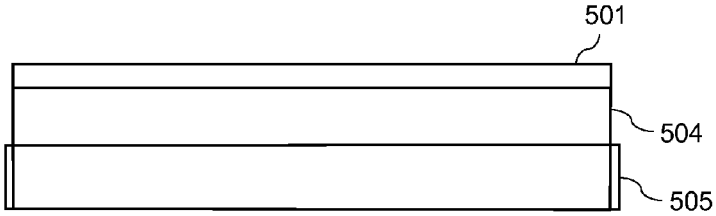
FIGS. 5A-C illustrate a preferred embodiment of the present invention including views of the binding clip (clamp), bi-fold leaf, and bi-fold leaf retainer.
Figure 5B:
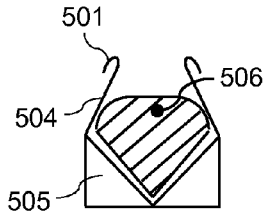
Figure 5C:
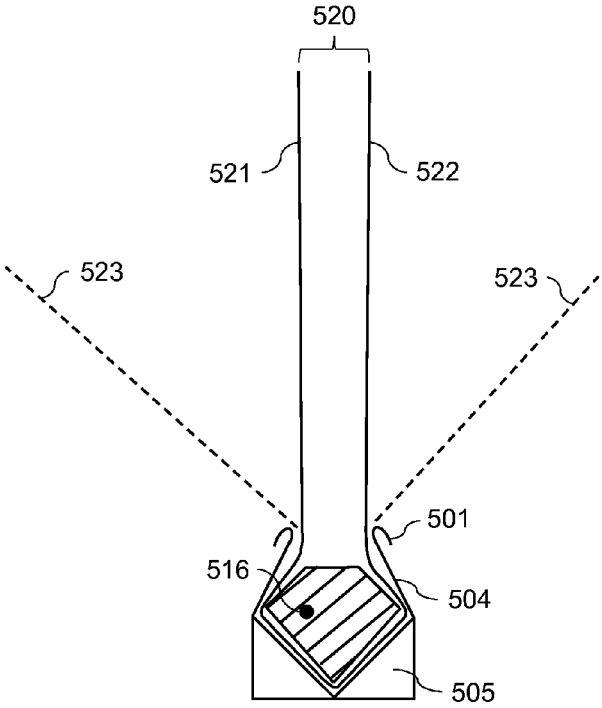

With reference to FIGS. 5A-B, there is illustrated a front and a side view, respectively, of the clamp, or binding clip, portion of a preferred embodiment of the present invention together with retainer 506 contained therein. FIG. 5C illustrates the preferred embodiment assembly of FIG. 5B having sheets 520 secured therein. Flexible clamping portions 504, terminating in upper lips 501, are flexibly biased toward each other for securely holding a retainer 516, having an optional straight-edged cross section different than the rounded cross section of retainer 506, and media sheets 520 positioned therein, as described below. This assembly with sheets can be compared to the preferred embodiment illustrated in FIG. 4B. The sheets are seen as multiple pages with front page 521 (e.g. page 1) whose opposite side is an interior page (e.g. page 2) and back page 522 (e.g. page 4) whose opposite side is an interior page also (e.g. page 3). FIG. 5C illustrates that pages 520 are actually a single continuous sheet that wraps around retainer 506 in the interior of the clamp portion 504. As mentioned above, the illustration of FIG. 5C is not intended to limit the shape of the sheet, clamp, or retainer in any way. The sheet can be composed of, for example, a flexible material portion that wraps around the retainer while the surfaces outside of the clamp that are exposed to view may or may not include stiffeners for reducing the flexibility of the exposed portions of the sheets. Stiffened sheets may comprise, for example, substantially stiff or rigid flat inserts as part of clear plastic sheets for holding printed images. They may also include relatively stiff media sheets that are connected together by a more flexible intermediate region—the flexible intermediate region for wrapping around the retainer within the clamp. The upper lip 501 of the clamp is rounded to protect against wear of the sheets that are secured therein as they are flexed open for viewing, as described below. This illustrated preferred embodiment utilizes a retainer design without a flange and with a binding clip portion as shown in FIGS. 1A-C, and can be used with the binding clip portion illustrated in FIG. 2B or any other form of binding clip shown herein or other forms not shown herein. This preferred embodiment as well as other embodiments illustrated herein can include multiple sheets wrapped around the retainer so that the booklet formed thereby will include more than four pages, and can include eight, twelve, sixteen or many more pages, depending upon the dimensions selected for the retainer and binder clip and the thickness of the sheets, more particularly, the thickness of the intermediate portion of the sheets that are wrapped around the retainer, as illustrated herein. Moreover, the different shapes of the cross-section of the retainers illustrated in FIGS. 4B, 5B, and 5C, for example, demonstrate that the binder clips and retainers are not limited by the examples illustrated herein, and can be interchangeable.

Referring again to the preferred embodiment of the present invention illustrated in FIG. 5C, the end of retainer 506 can be entirely visible when one or more multiple sheets are wrapped around it and secured within clamp portion 505. The clamping force applied by portions 504 against the sheets 522 within the clamp portion prevents the retainer from sliding out from between the sheets 520. The retainer can be optionally constructed with flanges as described previously or, also optionally, the clamp can be constructed with extended end portions 505 (not shown) to block both openings at the ends of the binding clip. FIG. 5B illustrates that the cross-section of the retainer portion can comprise various shapes and that the present invention is not directed to particular shapes of either of the retainer or clamp.

With reference to FIGS. 6A-I, there is illustrated front views of a binder clip and a retainer, FIGS. 6A, 6B, respectively; a perspective view of a binder clip, FIG. 6C; an end view of a retainer contained in a binder clip FIG. 6D; and optional binder clip/retainer arrangements 6E-I. Flexible clamping portions 604, each including an upper lip 601, are flexibly biased toward each other for securely holding the retainer, as explained above. The upper lip 601 can be rounded with a larger radius of curvature as explained above to protect against wear of the sheets that are secured therein. In the embodiment of FIG. 6C the base of the clip 603 is not flat. The binder clip illustrated in FIGS. 6A, 6C, 6D, and 6G includes two bottom surfaces 603 and a retainer having two substantially planar surfaces, or faces, facing the two bottom surfaces of the binder clip substantially in parallel. Preferred embodiments shown in FIGS. 6E, 6H show a flat bottom binder clip; 6F, and 6I a multiple surfaced bottom clip. Each of these is shown with a retainer having an equal number of surfaces facing these bottom surfaces substantially in parallel. The present invention is not limited only to a retainer having matching faces, however, as the retainers are intended to operably fit into binder clips having different numbers of bottom surfaces than the retainers have faces. FIG. 6B illustrates a flanged retainer which is an alternative means to prevent the retainer from slipping away from the binder clip when no sheets are present. The binder clip embodiments of FIGS. 6A-I do not include end portions such as shown at 105 of FIG. 1 for preventing a retainer enclosed within the clamp from sliding out therethrough. Although not a requirement of the presently illustrated preferred embodiment, the flanged retainer having flanges 607 larger than the cross section of the lengthwise opening through the binder clip prevents the retainer from sliding out of an open end of the binder clip. This advantage is illustrated in FIGS. 6B and 6D showing retainer 606 with flanges 607. In the side view illustration of FIG. 6D the binder clip's dimensions are greater than the flange retainer as can be seen by its lip 601 and base 603 extending beyond the edges of the flange. In contrast with the illustration of FIG. 3C, it is demonstrated that optional size relationships between flange and binder clip are possible and contemplated within the scope of the present invention. As mentioned above, the illustrations shown in these figures are not intended to limit the shape of the binder clip or retainer in any way. It merely demonstrates that the retainer may be more securely held within the clamp portion by avoiding unintended release of the retainer by means of end portions 607 formed thereon. To be fully utilized, the retainer and clamp should be separable in any event, as will be described in greater detail below. The retainer may be held in an open ended clamp by more tightly forming side portions 604 against the retainer as illustrated in FIGS. 6H and 6I (compare with FIGS. 6E and 6F). The side portions can be biased against the retainer to secure the retainer in position within the clamp by means of compressive force. This optional preferred embodiment may result in requiring more force to open side portions 604 when removing or inserting the retainer with or without sheets within the clamp.

Figure 7:
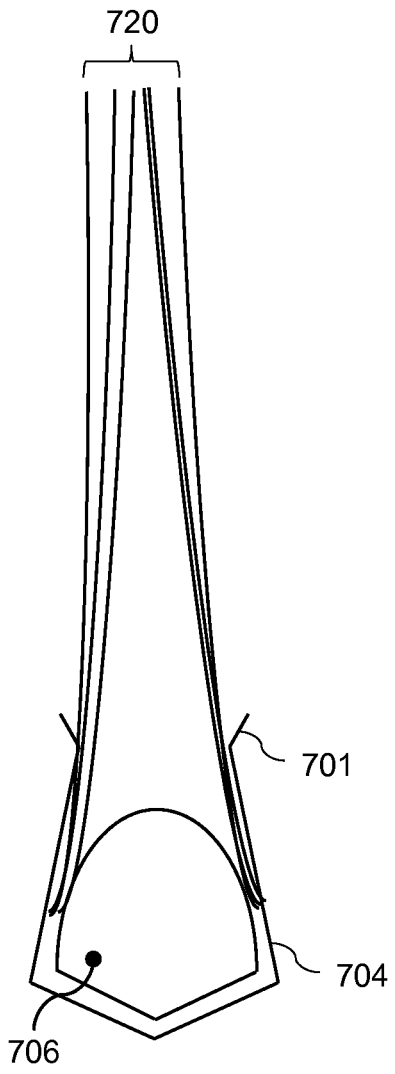
FIG. 7 illustrates another preferred embodiment of the present invention including views of the binding clip, non-wrapped sheets, and retainer.

With reference to FIG. 7, there is illustrated a side view of the clamp, or binding clip, portion of a preferred embodiment of the present invention with retainer 706 and sheets 720 (pages) secured therein. Flexible clamping portions 704, each including a deflected upper lip 701, are flexibly biased toward each other for securely holding the retainer 706, and sheets 720 positioned therein. The illustration of FIG. 7 is not intended to limit the shape of the clamp or retainer in any way. This embodiment of FIG. 7 demonstrates that the sheets may be secured between the sidewalls 704 and retainer 706 by pressure applied via the biased sidewalls 704, and do not require that the sheets comprise a middle section to wrap around the retainer.

Figure 8:
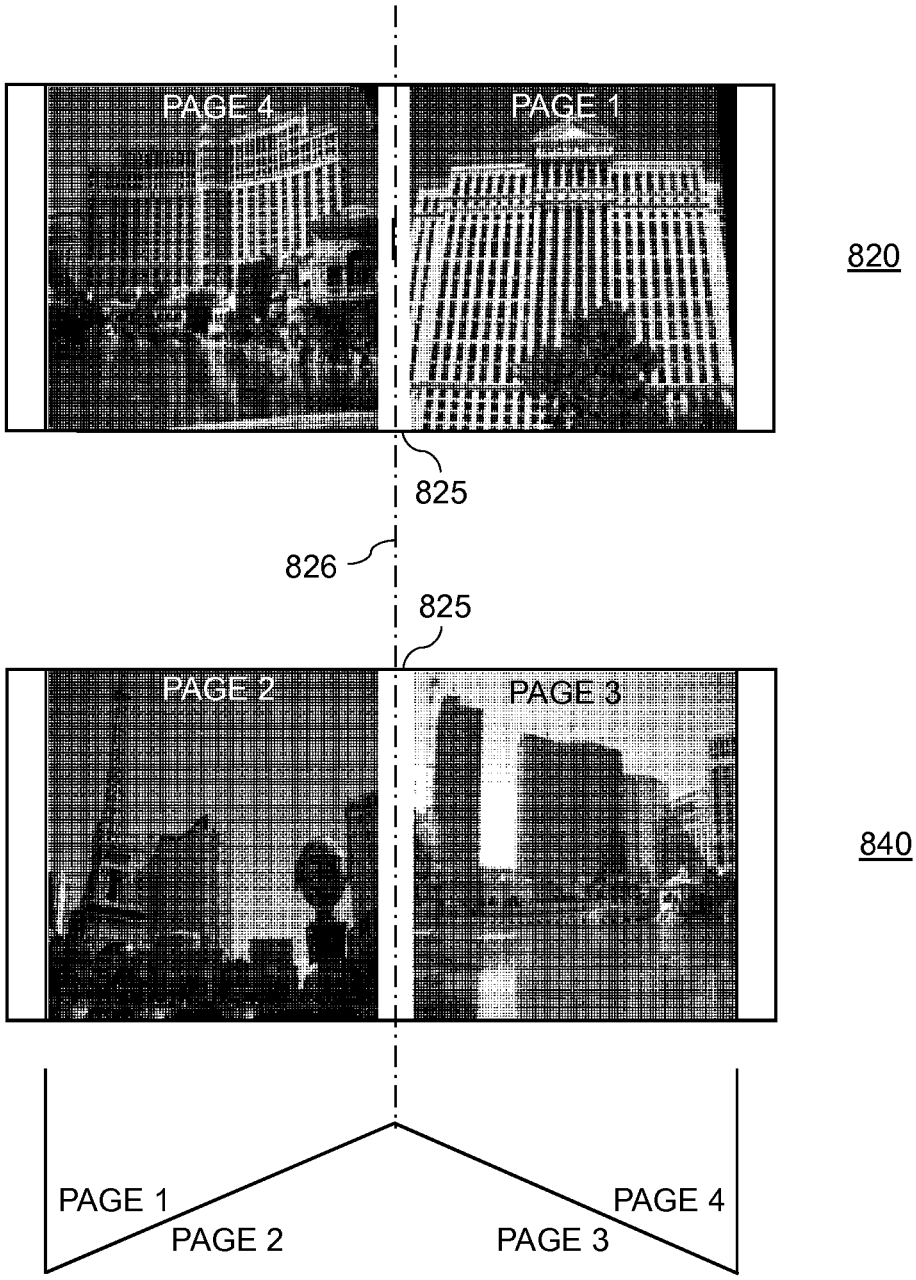
FIG. 8 illustrates double sided sheets secured by an embodiment of the present invention.

Referring to FIG. 8, there is illustrated an open book view of a preferred embodiment of the present invention. Views 820 and 840 are front and back sides of a single sheet which, when retained within a clamp as described above forms a book of four pages. Multiple ones of such a sheet can be stacked and retained within a clamp by placing a retainer on the sheets along the dotted line 826 in the intermediate area 825 between pages as shown in FIG. 8 and clamping the retainer and sheets within the clamp as shown and described above to form a photobook. Each additional sheet as shown can contribute four pages to a sheet stacked booklet as described herein. The unprinted intermediate portions of the sheet 825 on either side of the dotted line represents a middle section of the sheets that can be made of a different material than the printed portions of the sheet, such as a fabric or other flexible material that can easily wrap around the retainers described herein and can be securely attached to the sheets, for holding the sheets as pages in a photobook. As described herein, these intermediate portions can also be made of the same material as the printed portions. For example, the four pages can be constructed as one continuous sheet having a homogeneous construction in the printed portions and unprinted intermediate portions.

With reference to FIGS. 9A-H, there is illustrated an apparatus used in a method of bending to form the clamp, or binding clip, portion of the present invention, and is used for sheet metal parts. The retainer, which is a rod, dowel or similar shaped solid or hollow part is easily manufactured by, and is well known to, those skilled in the art and its manufacture is not further described herein. Parts 901 and 902 form part of a machine called a press brake that bends sheet metal 903. The lower part of the press, the die 902, contains a V shaped groove. The upper part of the press 901 contains a punch at its lower end that will contact and press the sheet metal 903 down into the V shaped groove, causing it to bend. There are several techniques used here, but the most common modem method is "air bending". Here, the die has a sharper angle than the required bend in the sheet metal (typically 85 degrees for a 90 degree bend) and the upper tool is precisely controlled in its stroke to push the metal down the required amount to bend it through 90 degrees. The opening width of the lower die is typically 8 to 10 times the thickness of the metal to be bent (for example, 5 mm material sheet could be bent in a 40 mm die). The inner radius of the bend formed in the metal is determined not by the radius of the upper tool, but by the lower die width. Typically, the inner radius is equal to ⅙th of the V shaped groove width used in the forming process.

The press usually has a back gauge 906 to position depth of the bend along the work piece. The back gauge can be computer controlled to allow the operator to make a series of bends in a component to a high degree of accuracy. Simple machines control only the backstop, more advanced machines control the position and angle of the stop. The machine can also record the exact position and pressure required for each bending operation to allow the operator to achieve a perfect measured degree bend across a variety of operations on the part.

Figure 9A:
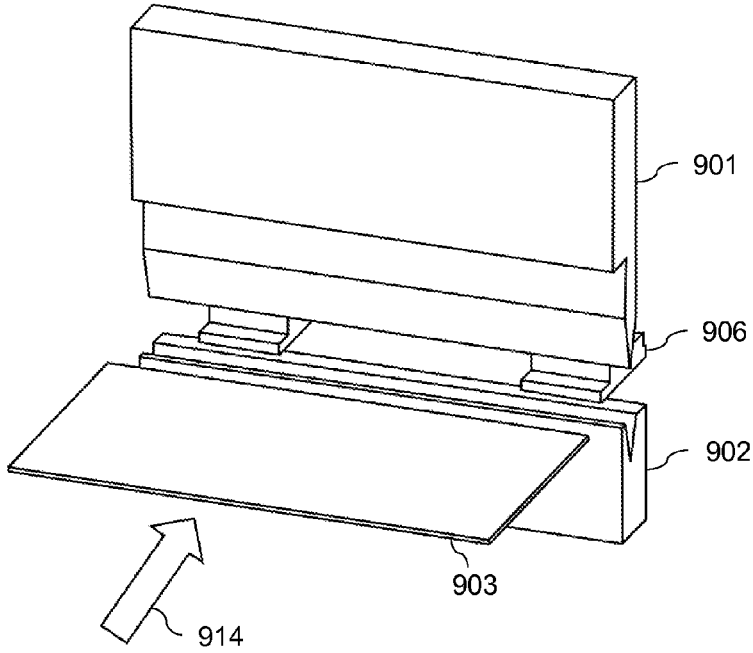
FIGS. 9A-H illustrate a method of making the binding clip of the present invention.
Figure 9B:
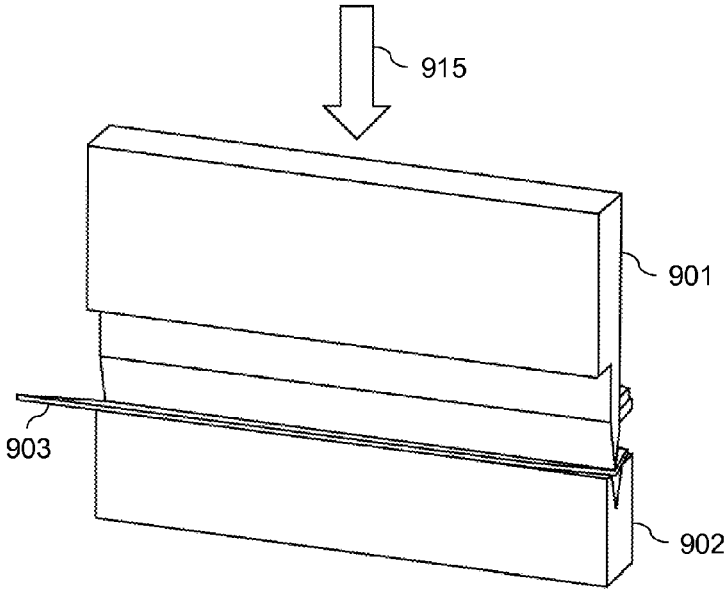
Figure 9C:
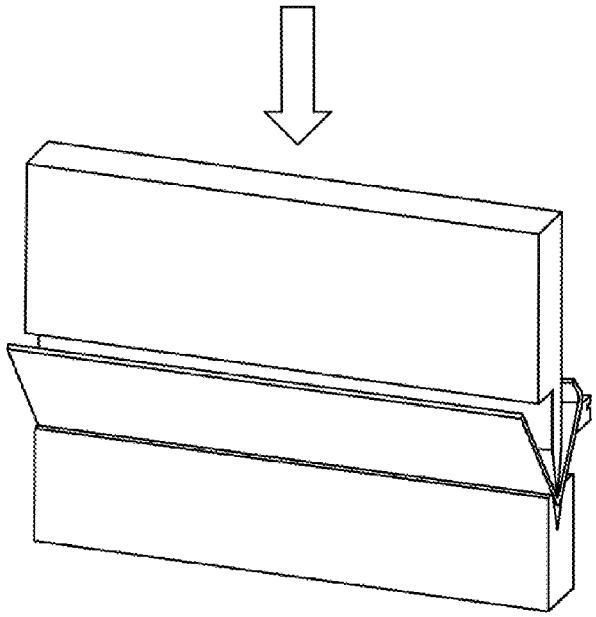
Figure 9D:
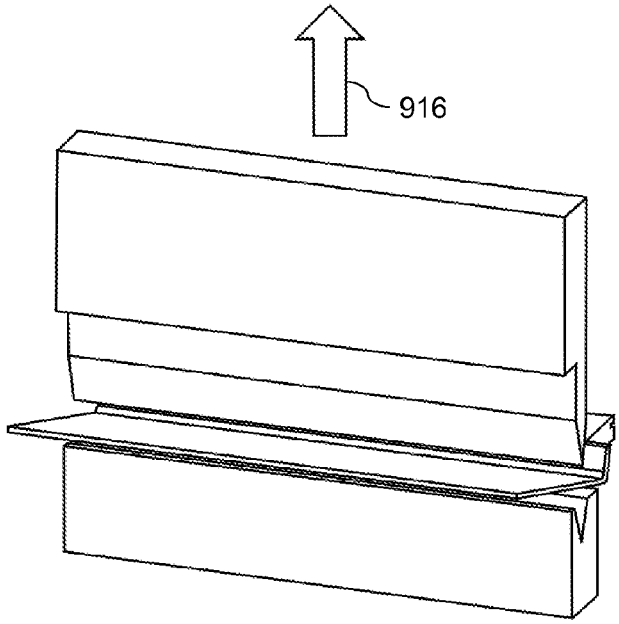
Figure 9E:
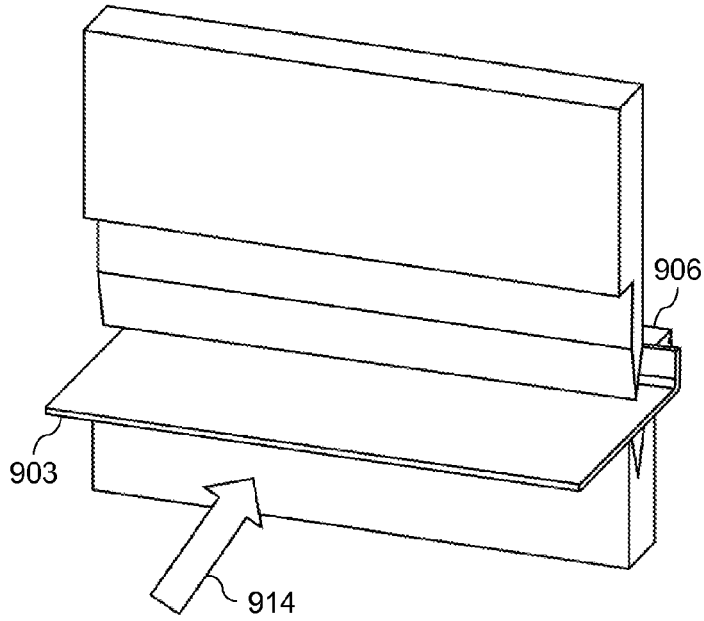
Figure 9F:
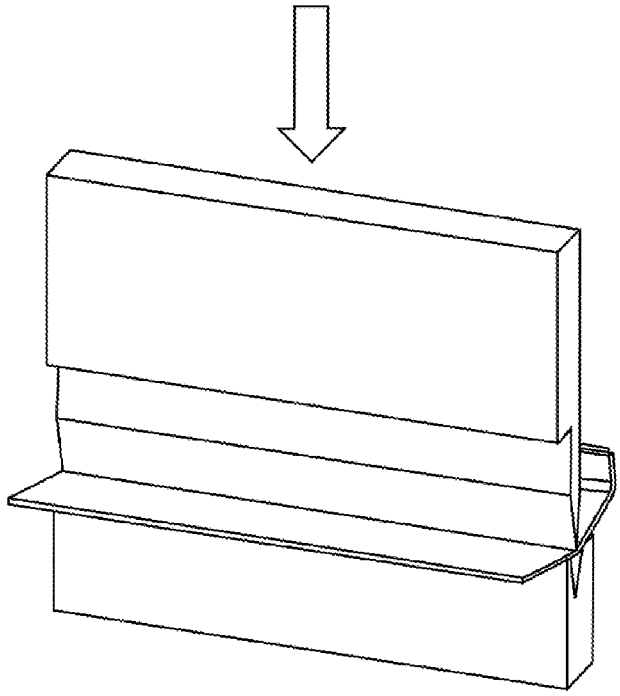
Figure 9G:
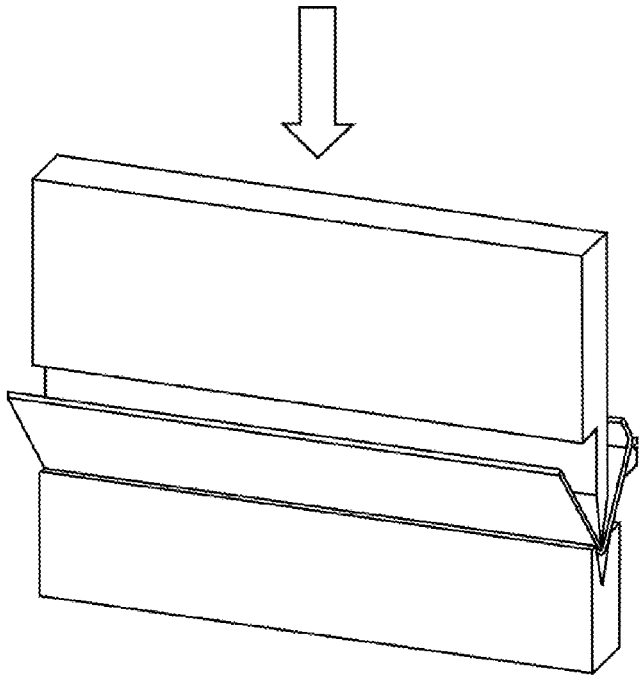
Figure 9H:
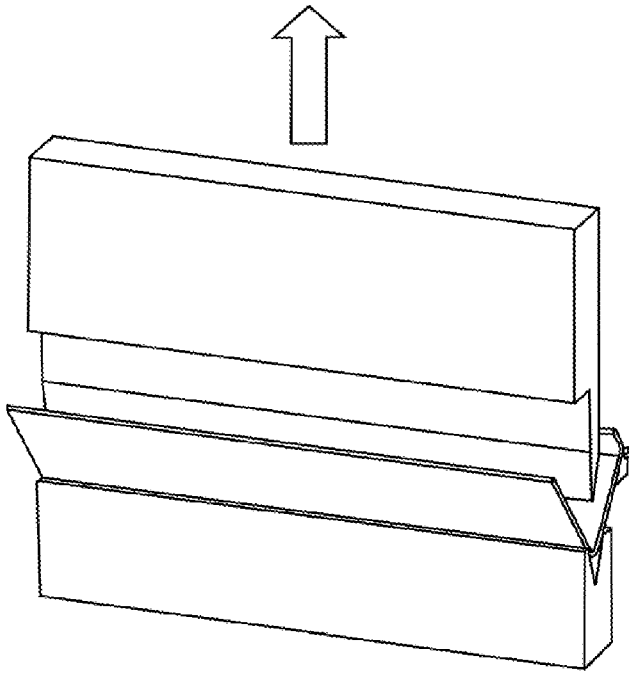

FIG. 9A shows the direction of movement 914 of the sheet metal 903 throughout the FIGS. 9A-H. The sheet metal is moved until an edge contacts back gauge 906 for depth positioning. FIG. 9B shows the direction of movement of punch portion 901 downward in direction 915 toward die 902 to bend sheet metal 903. FIG. 9C shows the punch portion at its lowermost position before being retracted in direction 916 shown in FIG. 9D. The steps shown in FIGS. 9E-H repeat the steps of FIGS. 9A-D, respectively, moving sheet metal 903 in direction 914 into a new position using the back gauge 906 as shown in FIG. 9E to form a bend in the sheet metal 903 adjacent to the bend formed by steps 9A-D. This procedure can be repeated several times on one piece of sheet metal using different positions of back gauge 906 and different depths of penetration of the punch to form bends of varying angles as necessary.

It will be understood that, although specific embodiments of the invention have been described herein for purposes of illustration and explained in detail with particular reference to certain preferred embodiments thereof, numerous modifications and all sorts of variations may be made and can be effected within the spirit of the invention and without departing from the scope of the invention. Accordingly, the scope of protection of this invention is limited only by the following claims and their equivalents.

PARTS LIST

101 Clip
102 Clip
103 Clip Bottom
104 Clip Side
105 Clip End
106 Retainer
201 Clip
204 Clip Side
306 Retainer
307 Flange
308 Cross Section
401 Clip
404 Clip Side
406 Retainer
407 Flange
415 Sheet or Material
420 Sheet
421 Page
422 Page
501 Clip
504 Clip Side
505 Clip End
506 Retainer
520 Sheet
521 Page
522 Page
523 Sheet
601 Clip
603 Clip Bottom
604 Clip Side
606 Retainer
607 Flange
660 Direction
701 Clip
704 Clip Side
706 Retainer
720 Sheets
820 Sheet
825 Intermediate Sheet Portion
826 Centerline
840 Sheet
901 Punch
902 Die
903 Sheet metal
906 Gauge
914 Direction
915 Direction
966 Direction

The invention claimed is:

1. An assembly for securing media sheets, comprising:

an elongated binding clip formed from a unitary flexible member including:

a first bottom surface;

a pair of spaced sidewalls coextensive with the first bottom surface and each integrally formed with the first bottom surface;

the pair of sidewalls converging toward each other to form a top opening between them, wherein the two elongated edges are flexibly biased toward each other; and a pair of end portions perpendicular to the pair of sidewalls and each integrally formed with the pair of sidewalls; and a retainer including a bar attached to flanges, substantially similar in length as the sidewalls and the bottom surface, disposed between the sidewalls and proximate to the bottom surface so that the flanges secure the retainer to the binding clip and the flanges prevent the retainer from rolling in the binding clip, the bar including one substantially flat surface that substantially faces the bottom surface, the bar being adapted to have the media sheets wrapped around it, such that when the bar with the wrapped media sheets is placed in the binding clip, the media sheets are secured within the elongated binding clip.

2. The assembly of claim 1, wherein the binding clip secures the media sheets together in a booklet form via a compressive biasing force of the sidewalls and elongated edges toward the retainer with the wrapped media sheets.

3. The assembly of claim 2, wherein the media sheets comprise photographic images positioned on both sides of the elongated retainer.

4. The assembly of claim 2, wherein the media sheets comprise photographic images on both top and bottom sides of each sheet.

* * * * *